US006224262B1

(12) United States Patent
Hogan et al.

(10) Patent No.: US 6,224,262 B1
(45) Date of Patent: May 1, 2001

(54) BAG WITH PERFORATED OPENING AND REINFORCING PATCH

(75) Inventors: John F. Hogan, Alpharetta, GA (US); James W. Yeager, Mobile, AL (US)

(73) Assignee: Innoflex Incorporated, Mobile, AL (US)

( * ) Notice: Subject to any disclaimer, the term of this patent is extended or adjusted under 35 U.S.C. 154(b) by 0 days.

(21) Appl. No.: 09/521,038

(22) Filed: Mar. 8, 2000

Related U.S. Application Data

(60) Provisional application No. 60/123,402, filed on Mar. 8, 1999.

(51) Int. Cl.[7] ..... B65D 33/24

(52) U.S. Cl. ..... 383/203; 383/61; 383/63; 383/66; 383/201; 383/208

(58) Field of Search ..... 383/61, 63, 66, 383/200, 203, 204, 207, 208, 209, 201

(56) References Cited

U.S. PATENT DOCUMENTS

| | | | | |
|---|---|---|---|---|
| Re. 33,674 | * | 8/1991 | Uramoto | 383/204 |
| 2,978,768 | | 4/1961 | Harrah . | |
| 3,266,965 | | 8/1966 | Spees . | |
| 3,397,835 | * | 8/1968 | Henning | 383/208 |
| 3,473,589 | | 10/1969 | Gotz . | |
| 4,655,862 | | 4/1987 | Christoff et al. . | |
| 4,691,373 | | 9/1987 | Ausnit . | |
| 4,756,629 | | 7/1988 | Tilman et al. . | |
| 4,909,017 | | 3/1990 | McMahon et al. . | |
| 5,022,530 | | 6/1991 | Zieke . | |
| 5,024,537 | * | 6/1991 | Tilman | 383/61 X |
| 5,026,563 | * | 6/1991 | Van Erden et al. | 383/204 X |
| 5,116,140 | | 5/1992 | Hirashima . | |
| 5,121,997 | * | 6/1992 | La Pierre et al. | 383/203 |
| 5,167,455 | | 12/1992 | Forman . | |
| 5,461,845 | * | 10/1995 | Yeager | 383/66 X |
| 5,601,368 | * | 2/1997 | Bodolay et al. | 383/66 X |
| 5,672,009 | * | 9/1997 | Malin | 383/61 X |
| 5,782,733 | | 7/1998 | Yeager . | |
| 5,806,984 | * | 9/1998 | Yeager | 383/66 X |
| 5,829,884 | * | 11/1998 | Yeager | 383/66 X |
| 5,902,047 | * | 5/1999 | Yeager | 383/66 X |
| 5,954,443 | * | 9/1999 | Yeager | 383/66 X |
| 6,019,512 | * | 2/2000 | Yeager | 383/66 X |
| 6,079,878 | * | 6/2000 | Yeager | 383/66 X |

FOREIGN PATENT DOCUMENTS

| | | | | |
|---|---|---|---|---|
| 0 528 721 | * | 2/1993 | (EP) | 383/66 |
| 1-308754 | * | 12/1989 | (JP) | 383/61 |

* cited by examiner

*Primary Examiner*—Jes F. Pascua
(74) *Attorney, Agent, or Firm*—Rockey, Milnamow & Katz, Ltd.

(57) ABSTRACT

A recloseable bag includes a bag body having a first wall and a second wall connected together substantially around proximate perimeters. The bag includesa first openable joint formed as perforations through the first wall and a patch secured to the first wall over the first openable joint. The patch has a second openable joint formed as perforations in registry with the perforations of the first openable joint. The patch can be composed of a material that tears in a controlled fashion along the perforations of the second openable joint. A zipper arrangement can be sealed to the inside surface of the patch.

12 Claims, 2 Drawing Sheets

BAG WITH PERFORATED OPENING AND REINFORCING PATCH

This application claims the benefit of provisional application U.S. Ser. No. 60/123,402, filed Mar. 8, 1999.

BACKGROUND OF THE INVENTION

Bags and methods of bag assembly are disclosed in U.S. Pat. No. 5,782,733 and U.S. Ser. No. 08/896,179, filed Jul. 17, 1997, both of which are herein incorporated by reference. The film material which constitutes the front wall of a typical bag is a biaxially oriented polypropylene, such as a reverse printed biaxially oriented polypropylene, or a cast polypropylene. This material rips or tears in an irregular fashion. Thus, if an openable joint is formed through such front wall, an even and orderly tearing along the joint is not assured.

SUMMARY OF THE INVENTION

According to the invention, a patch is provided to be attached to a wall of a bag wherein a zipper element is then attached to the patch. The wall includes an openable joint and the patch includes an openable joint in registry therewith. The openable joints are in registry with an openable mouth defined by the zipper arrangement. The patch reinforces the openable joint of the bag wall which otherwise would tend to tear prematurely or tear in an irregular and uncontrolled fashion. The patch can be composed of a material which tears in a controlled fashion along the openable joint of the patch. The openable joints of the bag wall and the patch can constitute perforations along a line or other pattern.

The film material which constitutes the wall of the bag can be a biaxially oriented polypropylene, such as a reverse printed biaxially oriented polypropylene, or a cast polypropylene. Although this material rips or tears in an irregular fashion, the patch material constitutes a material having a molecular orientation in a manner such as to have a directional tearing along the line of perforations. Such materials include polyethylene (PE), a polyethylene/ethylene vinyl acetate (EVA) blend, or a polypropylene, or any combination of the above in a blend or in a lamination or coextrusion.

The patch can be heat sealed to the bag wall and to the zipper element or can be adhesively secured to the bag wall and to the zipper element. In an exemplary embodiment, the patch is comprised of a polypropylene layer laminated with or coextruded with a polyethylene layer. The polypropylene layer is arranged adjacent the polypropylene front wall of the bag and the polyethylene layer is arranged adjacent the zipper element. Since the zipper element can be a polyethylene material, the patch can be heat sealed easily to the polyethylene zipper element. The polypropylene layer can be easily sealed to the front wall of the bag. Other polymers can be used having two or more layers such that one layer is compatible to be adhesively secured to, or heat sealed to, the bag wall film and a facing layer includes a surface which is compatible to be adhesively secured to, or heat sealed to, the zipper element. By using a lamination or coextrusion of a polypropylene layer and a polyethylene (or PE/EVA) layer, a relatively inexpensive polyethylene zipper element can be heat sealed to the patch and the patch can be heat-sealed to the polypropylene bag wall material.

Thus, the invention provides at least two advantages. A first advantage includes the use of a patch having an orientation to cause regular, linear ripping of the patch material along a line of perforations wherein the patch reinforces a portion of the bag wall to ensure that the bag wall rips along the line of perforations. As a second advantage, the patch can include a laminated or coextruded structure having different materials on opposite faces thereof, the laminated or coextruded patch being compatible for being secured to the bag wall on one face thereof and the zipper element on an opposite face thereof.

When the patch material is formed of a laminated layer arrangement, an adhesive can be used between the two layers to form the lamination. When a coextruded patch is used, the two layers can be coextruded together with or without a tie layer.

DETAILED DESCRIPTION OF THE PREFERRED EMBODIMENTS

Figure 1:
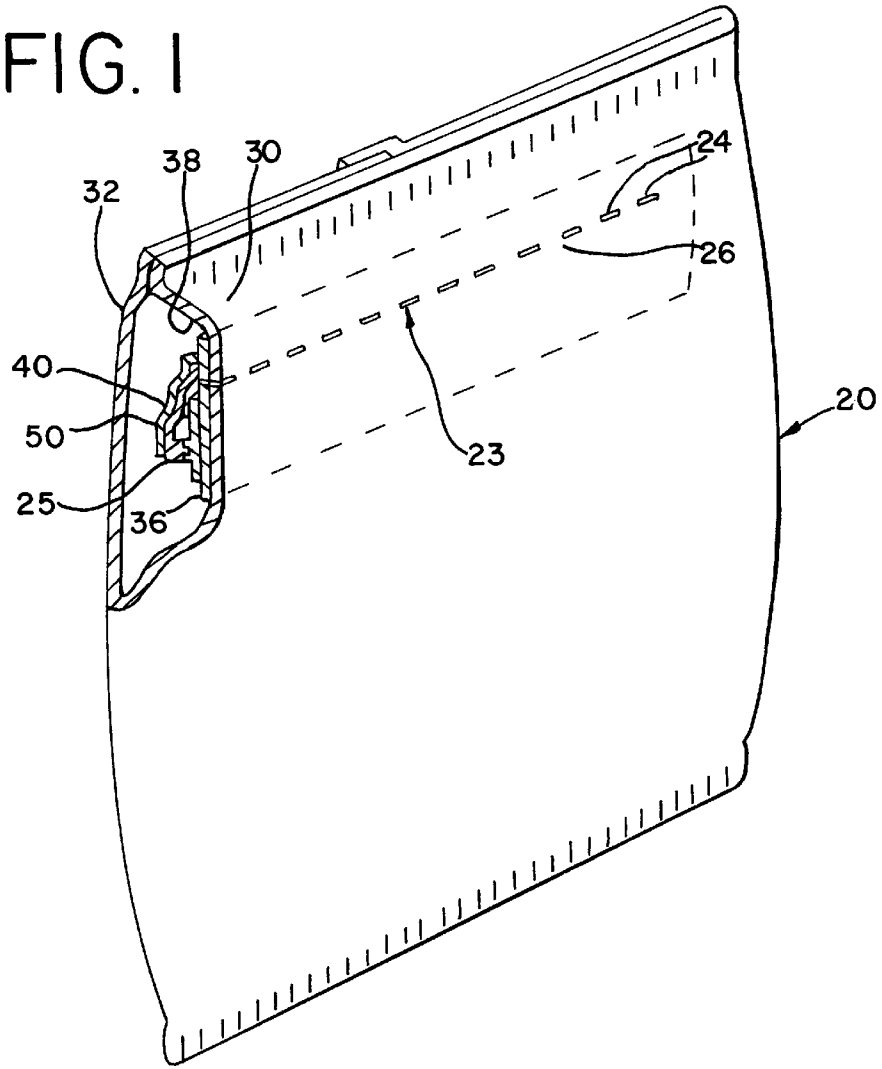
FIG. 1 is a perspective view, shown partly in section, of a recloseable bag of the present invention.
Figure 3:
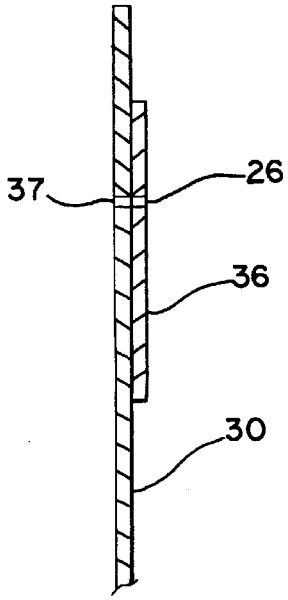
FIG. 3 is a cross-sectional view taken along line 3—3 of FIG. 2A.
Figure 4:
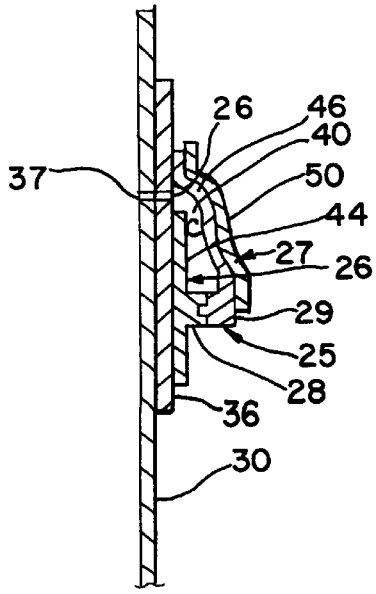
FIG. 4 is a cross-sectional view taken along line 4—4 of FIG. 2A.

While the present invention is susceptible of embodiment in various forms, there is shown in the drawings and will hereinafter be described presently preferred embodiments of the invention, with the understanding that the present disclosure is to be considered as an exemplification of the invention, and is not intended to limit the invention to the specific embodiment illustrated. FIGS. 1, 3 and 4 illustrate a recloseable bag 20 with an easy opening feature comprising an openable joint 23 defined by a plurality of perforations 24 for accessing a zipper element or arrangement 25. The perforation are arranged in a pattern 26 which can be a line or can be a thumb tab as disclosed in U.S. Ser. No. 08/986,138, filed Dec. 5, 1998. Bag panels 30, 32 are preferably made from barrier materials such as metalized polypropylene ("PP") that exhibits a high degree of tear propagation, that is, the bag material has a tendency to tear when perforated.

To prevent tear propagation when utilizing the easy open feature, a material patch 36 is placed over the bag material surface forming the inside of the bag that is to be perforated, as a means of supporting the bag material structure so that it does not tear prematurely or uncontrollably. The patch 36 is preferably made from a multilayered coextrusion or a laminated structure consisting of at least one layer being of a material that does not support tear propagation, with one layer forming a surface for attachment to the zipper arrangement 25 preferably including polyethylene ("PE") and another layer forming a surface for attachment to the inside surface 38 of the bag preferably including PP. The patch 36 includes an openable joint 37, in registry with the openable joint 23. The openable joint 37 is defined by a pattern of perforations 39 that can correspond to the pattern 26 in the bag wall.

Alternatively, it is encompassed by the invention that one of the openable joints 23, 37 is an open seam or cut and the respective other is perforated.

The zipper arrangement 25 includes first and second profile strips 27*a*, 27*b* that include interlocking elements 28, 29 formed with flanges 44, 46. The zipper arrangement has a peelable seal 40 between the flanges 44, 46 (as shown in FIG. 4) with at least one of the flanges being formed in part from a barrier material that has low permeability to at least moisture or gases (such as nitrogen and oxygen). The flange material is preferably made from polyethylene, as described in U.S. Pat. No. 5,806,984, which has a barrier tape 50 adhered to one side. The barrier tape is preferably formed from barrier materials such as EVOH, nylon, combinations thereof, or the like. One side of the barrier tape 50 can have adhesive applied thereto for attachment to the zipper flange 46, or the tape 50 can be heat sealed to the zipper flange 46. The zipper arrangement 25 can be hermetically sealed to the patch 36 that is attached to the inside of the bag.

Figure 2A:
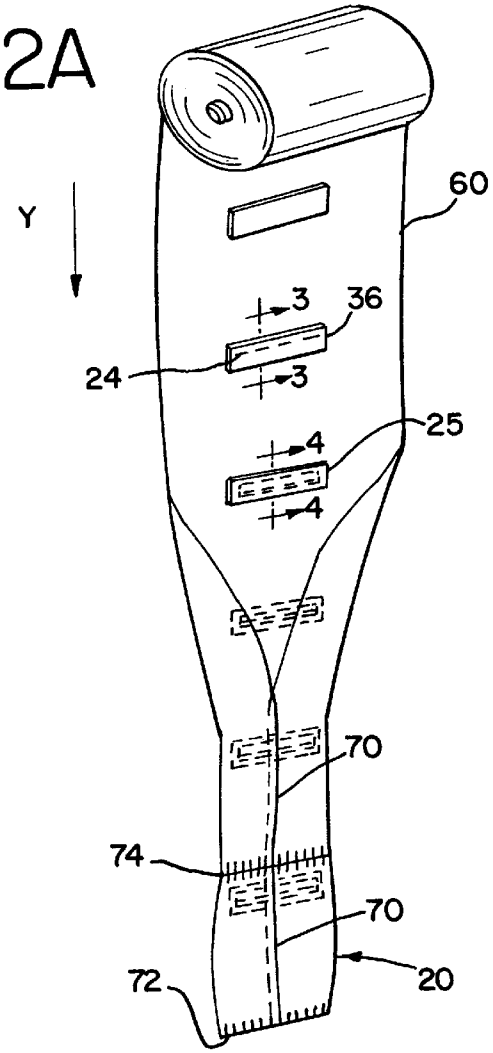
FIG. 2A is a perspective diagrammatic view of a method of making of the recloseable bag of the present invention.

A method of making bags 20 of the invention is illustrated schematically in FIG. 2A, including the steps of advancing a substantially continuous bag material 60 in a bag forming direction and feeding out the appropriate amounts of patch material, placing each patch 36 over, and attaching it to, the bag material 60; forming each easy access opening by making a plurality of perforations 24 through both the bag material and each patch; feeding out an appropriate amount of zipper material 64 including flange material 66 containing a barrier tape material, placing each zipper 25 over each patch 36 and hermetically securing it to the patch material, overlaying each patch 36 including the plurality of perforations, whereby each zipper arrangement 25 can properly be accessed through its perforation opening; folding the bag material to form a front panel 30 and a back panel 32; and forming seals 70, 72, 74 along the appropriate edges of each bag body to secure the panels together to form each resultant bag.

Figure 2B:
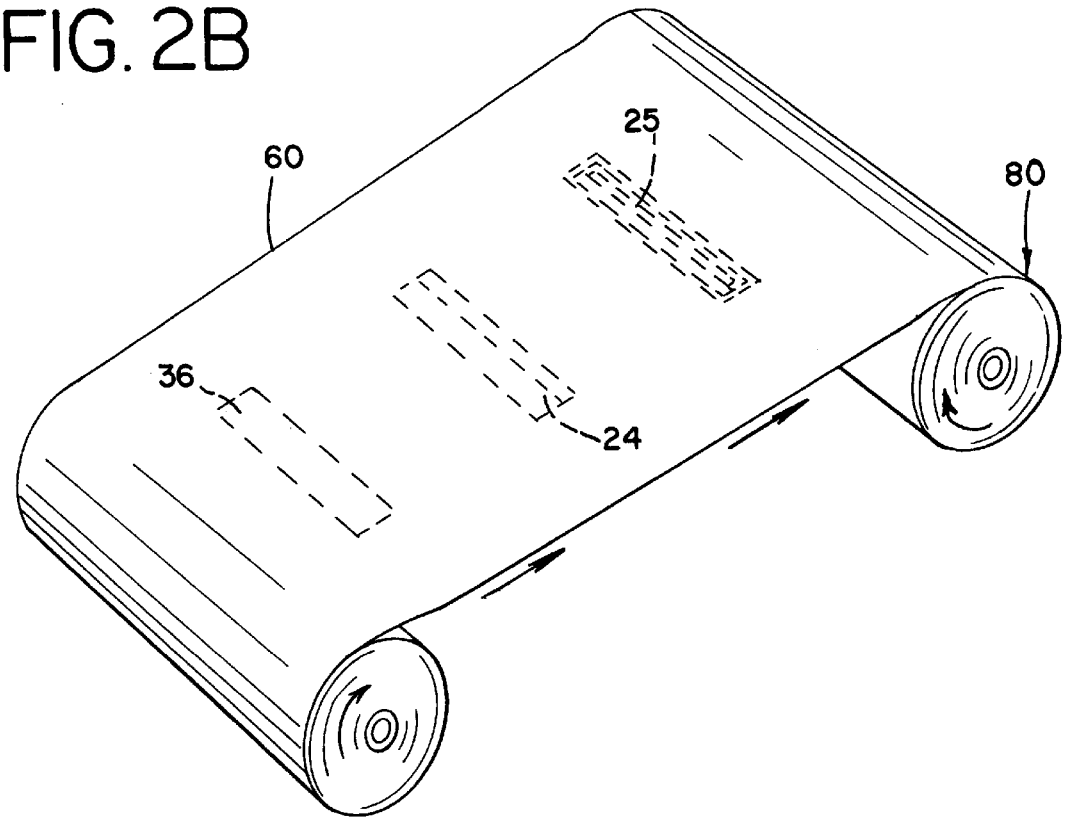
FIG. 2B is a perspective diagrammatic view of a method of making a rolled bag material useful in making the recloseable bag of the present invention.

The steps of the method of making bags of the present invention can be performed immediately following one another or additional steps can be added between various steps such as the storing of the bag material in a roll 80 or fan folded stack after any of the steps but prior to completion of the bag forming step. The additional step is illustrated in FIG. 2B.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. The disclosure is intended to cover all such modifications.

The invention claimed is:

1. A recloseable bag, comprising:

a bag body having a first wall and a second wall connected together substantially around proximate perimeters;

a first openable joint formed through said first wall;

a patch secured to said first wall over said first openable joint, said patch having a second openable joint in registry with said first openable joint, and a zipper arrangement secured to said patch on a side of said patch opposite said first wall, said zipper arrangement including first and second interlocking profile strips each having an interlocking element defining an openable mouth therebetween, and each having a respective supporting flange, said flanges being secured to said patch in spaced relationship on respective opposite sides of said second openable joint such that when said first and second openable joints are opened said joints are open to said openable mouth.

2. The bag according to claim 1, wherein said first openable joint and said second openable joint are formed by first and second patterns of perforations through said first wall and said patch respectively.

3. The bag according to claim 2, wherein respective corresponding perforations of said first and second patterns of perforations are in registry.

4. The bag according to claim 1, wherein said patch has a polymer orientation such as to cause linear ripping of the patch material along said second openable joint.

5. The bag according to claim 1, wherein said patch has a first layer composed of a first material that is compatible for heat sealing to said zipper arrangement, and a second layer that is compatible for heat sealing to the first wall.

6. The bag according to claim 1, wherein said zipper arrangement comprises polyethylene, and said first wall comprises polypropylene, and said patch is composed of a layer of polyethylene, facing said zipper arrangement, and a layer of polypropylene facing said first wall, said patch heat sealed to said first wall and said zipper arrangement heat sealed to said patch.

7. The bag according to claim 8, wherein said zipper arrangement includes a peelable seal arranged between said flanges to seal access between said openable joints and said openable mouth.

8. The bag according to claim 8, wherein said zipper arrangement includes a barrier tape overlying an inside surface of one of said flanges.

9. A recloseable bag, comprising:

a bag body having a first wall and a second wall connected together substantially around proximate perimeters;

a first openable joint formed through said first wall; and a patch secured to said first wall over said first openable joint, said patch having a second openable joint in registry with said first openable joint, said first openable joint and said second openable joint being formed by first and second patterns of perforations through said first wall and said patch respectively, said first wall being composed of a biaxially oriented polymer and said patch having a polymer orientation such as to cause linear ripping of the patch material along said second line of perforations.

10. A recloseable bag, comprising a bag body having a first wall and a second wall connected together substantially around proximate parameters;

a first openable joint formed through said first wall;

a patch secured to said first wall over said first openable joint, said patch having a second openable joint in registry with said first openable joint; and a zipper arrangement secured to said patch on a side of said patch opposite said first wall, wherein said zipper arrangement is composed of polyethylene, and said first wall is composed of polypropylene, and said patch is composed of a layer of polyethylene, facing said zipper arrangement, and a layer of polypropylene facing said first wall, said patch heat sealed to said first wall and said zipper arrangement heat sealed to said patch.

11. A recloseable bag, comprising:

a bag body having a first wall and a second wall connected together substantially around proximate perimeters;

a first openable joint formed through said first wall;

a patch secured to said first wall over said first openable joint, said patch having a second openable joint in registry with said first openable joint, and a zipper arrangement secured to said patch on a side of said patch opposite said first wall;

wherein said patch comprises an oriented polymer such as to cause linear ripping of the patch material along said first and second operable joints.

12. The bag according to claim 11, wherein said patch has a first layer that is compatible for heat sealing to said zipper arrangement, and a second layer that is compatible for heat sealing to the first wall.

* * * * *

UNITED STATES PATENT AND TRADEMARK OFFICE

CERTIFICATE OF CORRECTION

PATENT NO. : 6,224,262 B1
DATED : May 1, 2001
INVENTOR(S) : John F. Hogan and James W. Yeager It is certified that error appears in the above-identified patent and that said Letters Patent is hereby corrected as shown below:

Column 4,
Lines 27 and 31, "8" should be -- 1 --.

Signed and Sealed this

Twentieth Day of November, 2001

*Attest:*

Nicholas P. Godici

NICHOLAS P. GODICI
*Acting Director of the United States Patent and Trademark Office*

*Attesting Officer*